US009605931B2

(12) United States Patent
Laporte et al.

(10) Patent No.: US 9,605,931 B2
(45) Date of Patent: Mar. 28, 2017

(54) DEVICE FOR THROWING TARGETS FOR SHOOTING SPORTS, WITH INSTANT PROJECTION OF THE TARGET

(71) Applicant: Laporte Holding, Biot (FR)

(72) Inventors: Jean-Michel Laporte, Biot (FR); Jean-Marc Fouques, Claviers (FR)

(73) Assignee: Laporte Holding, Biot (FR)

( * ) Notice: Subject to any disclaimer, the term of this patent is extended or adjusted under 35 U.S.C. 154(b) by 0 days.

(21) Appl. No.: 14/412,628

(22) PCT Filed: Jun. 28, 2013

(86) PCT No.: PCT/EP2013/063713
§ 371 (c)(1),
(2) Date: Jan. 2, 2015

(87) PCT Pub. No.: WO2014/005952
PCT Pub. Date: Jan. 9, 2014

(65) Prior Publication Data

US 2015/0168108 A1 Jun. 18, 2015

(30) Foreign Application Priority Data

Jul. 3, 2012 (FR) ..... 12 56362

(51) Int. Cl.
*F41J 9/20* (2006.01)
*F41J 9/24* (2006.01)

(52) U.S. Cl.
CPC .. *F41J 9/20* (2013.01); *F41J 9/24* (2013.01)

(58) Field of Classification Search
CPC ..... F41J 9/20; F41J 9/24
See application file for complete search history.

(56) References Cited

U.S. PATENT DOCUMENTS 1,475,713 A 11/1923 Napier
2,245,258 A * 6/1941 Darrell ..... F41J 9/20 124/8

(Continued)

FOREIGN PATENT DOCUMENTS

| | | |
|---|---|---|
| FR | 2093065 | 1/1972 |
| FR | 2238136 | 2/1975 |
| FR | 2787181 | 6/2000 |

OTHER PUBLICATIONS

International Search Report dated Oct. 7, 2013, for International Application PCT/EP2013/063713, filed Jun. 28, 2013, Applicant, Laporte Holding (4 pages).

(Continued)

*Primary Examiner* — Gene Kim
*Assistant Examiner* — Jeffrey Vanderveen
(74) *Attorney, Agent, or Firm* — McCracken & Gillen LLC

(57) ABSTRACT

The present invention relates to a device for throwing targets for shooting sports, with instant projection of the target. The device is characterized in that it comprises means for blocking the movement of the arm in abutment, enabling the arm, to go beyond the "zero point", by the action of the driving means, while keeping the throwing means in tension, with these blocking means being carried by the driving means and engaging with complementary blocking means carried by the arm, and wherein the throwing arm comprises a rotating shaft, with said shaft carrying a pinion driven by a second drive pinion connected to the output pin of the driving means comprising a geared motor, with the means for blocking in abutment having a stop carried on the periphery of a crank pin rotating about the output pin of the geared motor. Applications in the field of shooting sports, both rifle shooting or revolver shooting and in archery.

10 Claims, 11 Drawing Sheets

(56) References Cited

U.S. PATENT DOCUMENTS

| | | | | | |
|---|---|---|---|---|---|
| 3,097,635 | A | | 7/1963 | Freeman | |
| 3,470,860 | A | * | 10/1969 | Kane | F41J 9/20 124/34 |
| 5,937,839 | A | * | 8/1999 | Nilsson | F41J 9/24 124/8 |

OTHER PUBLICATIONS

English language translation of International Written Opinion dated Oct. 7, 2013, for International Application PCT/EP2013/063713, filed Jun. 28, 2013, Applicant, Laporte Holding (6 pages).

* cited by examiner

DEVICE FOR THROWING TARGETS FOR SHOOTING SPORTS, WITH INSTANT PROJECTION OF THE TARGET

TECHNICAL FIELD OF THE INVENTION

The present invention relates to a device for throwing targets for shooting sports with the instant projection of the target, i.e., with the fastest possible throwing of the target when the order to throw has been given.

It is particularly applicable to the field of training for shooting sports whether using a rifle, a gun or even a bow, especially with a voice-operated throwing installation of the trench or skeet type that must react very quickly to the shooter's call.

STATE OF THE ART

Targets throwing devices for shooting sports are known, with such targets being in the form of clay saucers. One of these devices is disclosed for example in document FR-A-2787181.

Such devices have been satisfactory in general, but are not suitable for some shooting disciplines when an almost instant projection of the target is required, with such projection following the shooter's call, for instance.

FIG. 1 shows a throwing device of the state of the art according to one embodiment enabling an instant projection.

According to the throwing device 1*a* shown in FIG. 1, a target intended to be thrown, not shown in FIG. 1, is projected by a rotating arm 2 provided with a rubber fixture 27. The target is positioned at mid span of the arm 2 against the fixture 27.

The arm 2 is articulated about a substantially vertical axis A2 and is fastened to the upper end of a shaft 3 supported by a crosspiece 8*a* carried by the upper body 8 of the device 1*a*, with said shaft 3 being free to rotate relative to this upper body 8. During the throwing operation, the arm 2 rotates about said A2 axis and undergoes angular acceleration which presses the fixture 27 while making the latter roll towards its end. The target is then ejected while spinning around.

The arm 2 is indirectly secured by means of the shaft 3 of a rod 4 rotating about the A2 axis, with one end of the connecting rod 4 being connected to the lower end of the shaft 3. At its other opposite end, the connecting rod 4 comprises a nipple 5 disposed on the side of the rod facing away from the arm 2 and protruding downwards. This nipple 5 of the connecting rod 4 is secured to one end of a draw-spring 6, with the other end of the draw-spring 6 being fastened to the upper body 8 of the device 1*a*. The connecting rod 4 is also mechanically connected to a free wheel 7 mounted on the shaft 3.

In the lower part of the device 1*a*, a geared motor 9 is carried by the lower body 8*b* of the device 1*a*. This geared motor 9 drives in rotation, through said lower body 8*b*, a crank pin 10 the axis of rotation of which is coaxial with the axis of rotation A2 of the connecting rod 4 and the arm 2. A nipple 11, protruding above the crank pin 10, is provided on the crank pin 10, and the trajectory of which, during the rotation of the crank pin 10, meets that of the nipple 5 positioned at the end of the connecting rod 4, with such end not being adjacent to the shaft 3. Both nipples 11 and 5 interfere with each other, this advantageously on a height of approximately 3 millimeters.

Located substantially above the attachment of the draw-spring 6 on the upper body 8 of the device 1*a*, is provided a switch 12 which matches the trajectory of one portion of the arm 2 when the latter has rotated about its A2 axis, with such portion being advantageously the end portion of the arm 2.

In such a device 1*a*, the arm 2 rotates about the upper 8 and lower 8*b* body of the device 1*a*, with the rotation of the arm 2 being advantageously executed counter-clockwise with the free wheel, thus preventing any rotation 7 of the arm 2 in the opposite direction.

To initiate the throwing of a target, a remote throwing means commands the geared motor to turn 9. During this step, also called the step of cocking, the crank pin 10 rotates about the pin coaxial with the axis of rotation A2 of the arm 2 and the nipple 11 moves until it comes in contact with the nipple 5 carried by the connecting rod 4, advantageously in linear contact. The connecting rod 4, the shaft 3 and the arm 2 are then driven in rotation until the arm 2 abuts against the contactor 12. Ideally, this stop is as close as possible to a so-called "zero point".

At the zero point, the arm is not submitted to a torque and thus a balance between the step of cocking and the step of throwing is obtained.

When the arm 2 rotates on counter-clockwise, its going beyond the zero point generates a driving torque on the arm through the tensioned spring 6, if no obstacle opposes such torque then the draw-spring 6 suddenly relaxes and the release of the arm 2 causes the throwing of the target. During the step of throwing by ejecting the target out of the device 1*a*, the arm 2 almost immediately rotates, by the action of the draw-spring 6 relaxing. The arm 2 then successively crosses a so-called rest position, at 180° from the "zero point" which it goes beyond due to its inertia until it reaches a position at 270° from the "zero point". This position is maintained by the free wheel 7 which prevents any rotation in the opposite direction.

In the device of the prior art, the geared motor 9 is stopped when the arm 2 goes beyond the "zero point" in order to ensure an immediate release upon the order to throw. This position is called the throwing position. The balance of the system is then forced and is obtained by adding a moving obstacle on the trajectory of the arm 2. This obstacle consists of a trigger 13 pivoting about a pin 14. The trigger 13 is maintained in contact with an electromagnet rod 15 via a return spring 16.

When the electromagnet 15 is energized, it rotates the trigger 13, thereby releasing the arm 2. This results in an extremely short response satisfactory for the almost instant throwing applications.

However, this arrangement has several disadvantages. Using an electromagnet 15 increases the price of the device 1*a* and may generate various problems even a blocking of the device 1*a*. Thus, the electric control which must drive the electromagnet 15 before the geared motor 9 may fail and/or the core of the electromagnet 15 may get stuck, as well as the trigger 13, which is a problem.

One possible consequence is the trigger 13 being locked in the open position, with the arm 2 thus operating in burst. Human intervention is then required not to throw targets unnecessarily.

Another possible consequence is the blocking of the trigger 13 in the closed position. In this case, the geared motor 9 pushes the arm 2 to crush the latter. Human intervention is required to unlock the mechanism. Once the obstacle is released, the arm 2 produces its acceleration by making a rapid rotation on 270°. As a draw-spring 6 commonly used requires 100 to 200 kg to be stretched, the energy released during its expansion is directly proportional to its stiffness. Danger is then real for the repairman and extreme caution is required during the repair operations.

A targets throwing device with a mechanical device to hold the targets throwing arm before the order to throw is also known from document FR-A-2238136. This device uses a stop element directly carried by the arm driving pin. Therefore, there is very little tolerance for operational variations (vibration, expansion for example) and the risk of malfunction exists.

SUMMARY

The object of the present invention is to design a target throwing device which can have an almost instant response to an order to throw while improving security issues and the cocking time of the devices of the prior art.

For this purpose, the invention provides a device for throwing targets comprising a rotationally movable throwing arm, throwing means and driving means intended for cocking the arm by rotation of said arm up to a so-called "zero point" position, where the throwing means are in tension without exerting a torque on the arm characterized in that it comprises means for locking the movement of the arm in abutment, carried by the motor means and complementary locking means carried by the arm, with the means for locking in abutment and the complementary locking means being so configured as to lock the arm beyond the "zero point" on a predetermined angular sector in the direction of rotation of the arm in a throwing position wherein the throwing means in tension exert a torque on the arm and to release the arm beyond the throwing position wherein the throwing means relax to rotate the arm for throwing the target.

The technical effect is an almost instant projection of the target when the driving means substantially go beyond the "zero point" and the locking means become inoperative. The solution provided by the present invention has the advantage of providing a short step of cocking with as short as possible a time for throwing the next target upon the shooter's call.

Besides, this is achieved with locking means carried by the driving means, with such locking means being rendered inoperative when the driving means are operated again and the arm moves away from the "zero point", which ensures a much safer operation of the device than with the trigger and electromagnet system of the prior art.

In the embodiment where the invention comprises a pinions system, the rotation of the pin and of the throwing arm and that of the locking means, in particular of the stop can be shifted and differentiated. Thus, as regards their functioning and positioning, the locking means may be so adjusted as to avoid being able to act on a narrow range of positions relative to the arm and stop locking means only. Using such a configuration for adjusting the throwing is particularly advantageous.

Optionally, the invention further includes at least any one of the following characteristics:

- the throwing arm comprises a rotating shaft, with said shaft carrying a pinion driven by a second drive pinion connected to the output pin, with driving means comprising a geared motor, with the means for locking in abutment having a stop carried on the periphery of a crank pin rotating about the output pin of the geared motor.
- the crank pin is mounted on a free wheel, with said free wheel enabling the crank pin to rotate in the direction opposite the direction of rotation of the geared motor.
- the stop of the crank pin is carried by a pin eccentric relative to the output pin of the geared motor, with said stop being in the form of a roller rotating at the upper end of the eccentric pin.
- the complementary locking means carried by the arm are in the form of a lug contacting the stop carried on the periphery of the crank pin upon rotation of the arm beyond the "zero point".
- the two gears are driven by a chain or a belt running around said pinions.
- a free wheel is inserted into the pinion carried by the shaft rotating the arm, with the outer cage of the free wheel rotating in the direction of rotation of the arm.
- the device comprises a body remaining stationary during the rotation of the arm, with a stop made integral with said body bearing against the edge of the crank pin.
- the stop is pressed by the action of an elastic means against the edge of the crank pin
- the throwing means are in the form of a draw-spring adapted to be tensioned upon rotation of the arm, with the return of the spring to the relaxed position causing the rotation of the arm for enabling the throwing of the target by the arm.
- the draw-spring is fixed at one of its ends to the body of the device, with its other end being articulated on one end of a connecting rod the other end of which is connected to the shaft of rotation of the arm.

The invention also relates to a method for throwing a target using a throwing device as described above, which method comprises the following successive steps:

- cocking the arm by rotation of the arm driven by the motor means up to the "zero point",
- driving the arm up to the throwing position beyond the zero point in the direction of rotation of the arm
- locking the arm in the throwing position, while keeping the throwing means in tension,
- restarting the motor means, further to an order to throw to unlock the arm and throwing of the target by the arm by releasing the throwing means.

According to one possibility, the motor means are shutdown prior to locking the arm in the throwing position.

Advantageously, the method includes a step of maintaining the arm in its final rotating position after the throw, with said final position being the starting position for the step of cocking a new throwing cycle.

BRIEF DESCRIPTION OF THE FIGURES

Other characteristics, aims and advantages of the present invention will appear upon reading the following detailed description and referring to the appended drawings given as non restrictive examples and wherein:

FIG. 2 is a schematic representation of a perspective view of a targets throwing device according to the present invention, in rest position, FIG. 3 is a schematic representation of a perspective view of a targets throwing device according to the present invention, in the position, following the throwing at 270° from the "zero point", a position which can also be the starting position of the step of cocking the device, FIG. 4 is a schematic representation of a perspective view of a targets throwing device according to the present invention, in a throwing position beyond the zero point and with means for locking the arm in action, FIG. 5 is a schematic representation of a perspective view of a targets throwing device according to the present invention, in a throwing position, with the arm locking means being no longer active, with such position corresponding to the start of the target throwing, FIG. 6 is a schematic representation of a perspective view of a targets throwing device according to the present invention, in a position during the throwing following that of FIG. 5, FIG. 7 is a schematic representation of a perspective view of a targets throwing device according to the present invention, in a throwing position subsequent to that of FIG. 6, with such position being an intermediate position reached during the throwing of the target.

FIG. 8 corresponds to the state of the device shown in FIG. 2: the rest position.

FIG. 9 corresponds to the state of the device shown in FIG. 3: the position, after the throwing at 270° from the zero point.

FIG. 10 corresponds to the state of the device subsequent to the state shown in FIG. 9, during the step of cocking.

FIG. 11 corresponds to a state subsequent to that of FIG. 10 and located between the one shown in FIG. 3 and the one in FIG. 4: at the zero point position.

FIG. 12 corresponds to the state of the device shown in FIG. 4: the throwing position.

FIG. 13 corresponds to the state of the device shown in FIG. 5: after the throwing position during the throwing of the target.

DETAILED DESCRIPTION OF THE INVENTION

In the following, a targets throwing device used in shooting sports such as clay pigeon shooting and thus frequently using clay targets will be described. It should be noted here that the present invention is not limited by such use and that it may relate to the throwing of foam targets, for example for archery.

Similarly, targets may also be thrown substantially in the air with a significant vertical component or substantially at ground level with a significant horizontal component.

"Carried" means that the two elements are made kinematically integral with one another. All the configurations respecting such kinematic simultaneity fall within the scope of the invention. The two elements may be directly or indirectly connected to each other.

Figure 1:
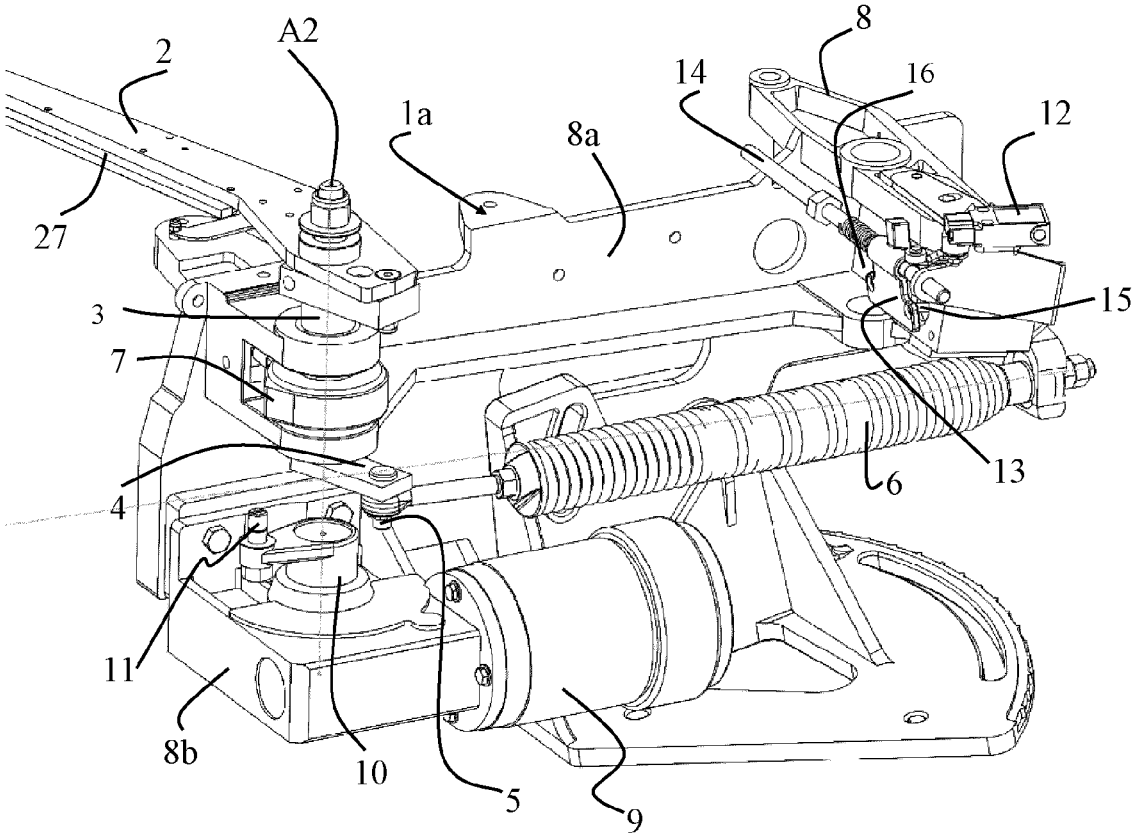
FIG. 1 is a schematic representation of one known embodiment of the prior art, with a perspective view of a device for throwing targets.

FIG. 1 has already been described in detail in the introduction of this application.

The device 1 of the invention uses some characteristics of the device of FIG. 1 but, for such device 1, a set of pinions 17, 18 and a chain 19 or a belt have been substituted for the nipples 5 and 11 shown in FIG. 1, while modifying the position of the geared motor 9 accordingly.

The characteristics of the arm 2 positioned at one end of a shaft 3 having a free wheel 7 while a connecting rod 4 is positioned at the other end remain substantially unchanged. The connecting rod 4 has one end connected to the shaft 3 while its other end has a pivot 5*a* hinged at one end 6 of the draw-spring, with the other end of the draw-spring 6 being connected to the point 28 of the upper body 8 of the device 1*b*.

The driving assembly specific to this embodiment comprises a geared motor 9 driving a drive pinion 18 itself connected by a transmission chain or belt 19 to a pinion 17 carried by the shaft 3. The free wheel 7 of the shaft 3 cooperates with the pinion 17. The geared motor 9 is positioned so that its output pin A1 is remote and parallel to the axis of rotation A2 of the arm 2. The drive pinion 18 having a smaller size than the pinion 17 and connected to the latter by means of the chain 19 is positioned at the output end of the geared motor 9.

A contactor 12 is located on the rotating path of the arm 2, above the end of the draw-spring 6 connected to the upper body 8. A remote triggering device commands the geared motor 9 to rotate, with the pinion 18 driving the pinion 17 through the chain 19. With the outer cage of the free wheel 7 rotating counter-clockwise, the free wheel 7 is secured to the connecting rod 4. The system evolves until the contactor 12 is intercepted by the arm 2.

When the arm 2 and the pivot 5*a* go beyond the "zero point", the draw-spring 6 then acts on the connecting rod 4 counter-clockwise, which results in an acceleration of the arm 2. Because of the inertia of the system the arm stops at about 270° from the "zero point". This position can be held because of the free wheel 7. With the geared motor 9 operating on, the free wheel 7 becomes driving again and drives the connecting rod 4 again for a new step of cocking.

Figure 2:
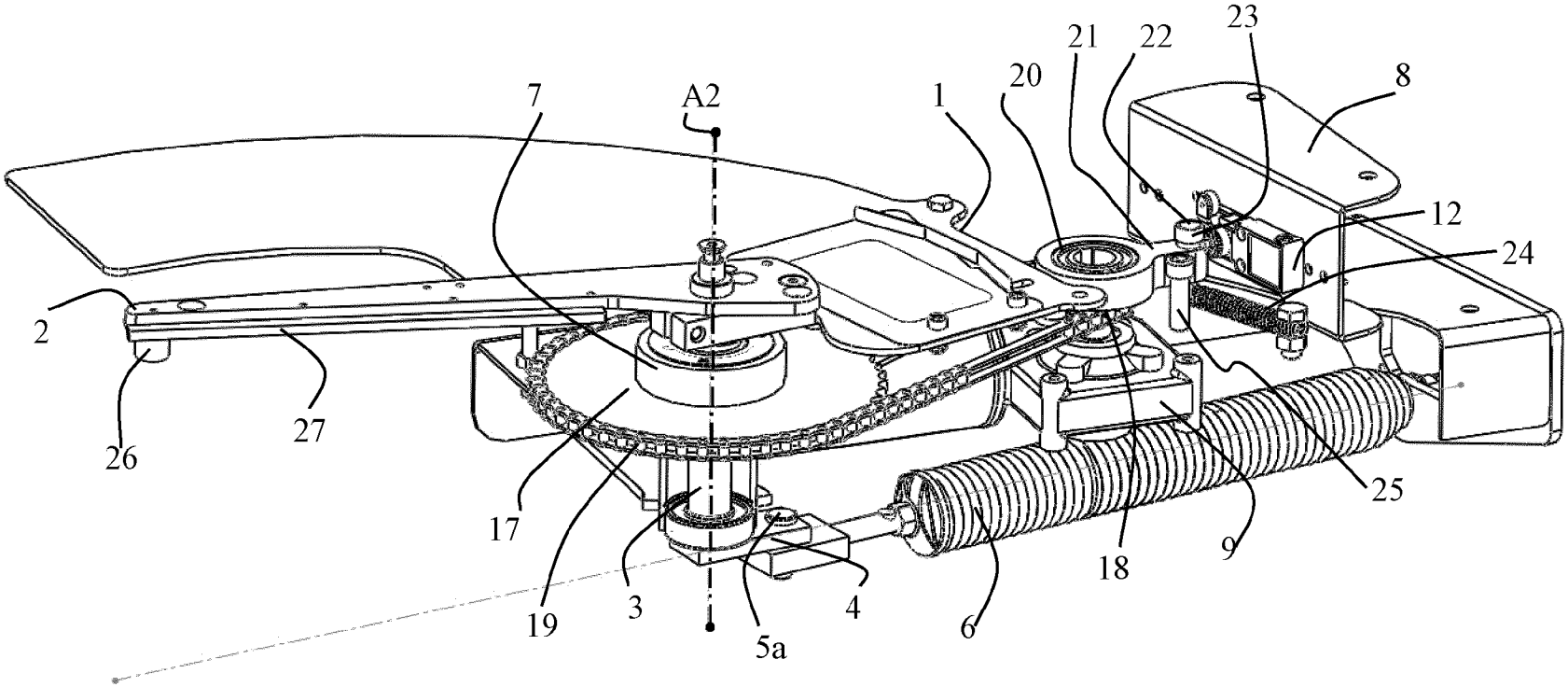
FIGS. 2 to 7 illustrate kinematics of the device according to the invention, in perspective view.

As shown in FIG. 2, the device 1 according to the invention comprises a connecting rod 4 connected to the lower end of the shaft 3 of rotation of the arm 2 rotating about a pin A2. The connecting rod 4 is articulated at its other end with one end of the draw-spring 6 by a pivot 5*a*. The draw-spring 6, acting as throwing means and having a substantially elongated rectilinear shape, has its other end secured to the lower portion of the upper body 8 of the device 1, bearing reference 28. The X1, X2 axes respectively of the connecting rod 4 and the spring 6 are shown in FIGS. 8 to 13. The X3 axis illustrates the line going through the centre of the connecting rod 4 and the junction point 28 between the spring 6 and the body 8.

Figure 8:
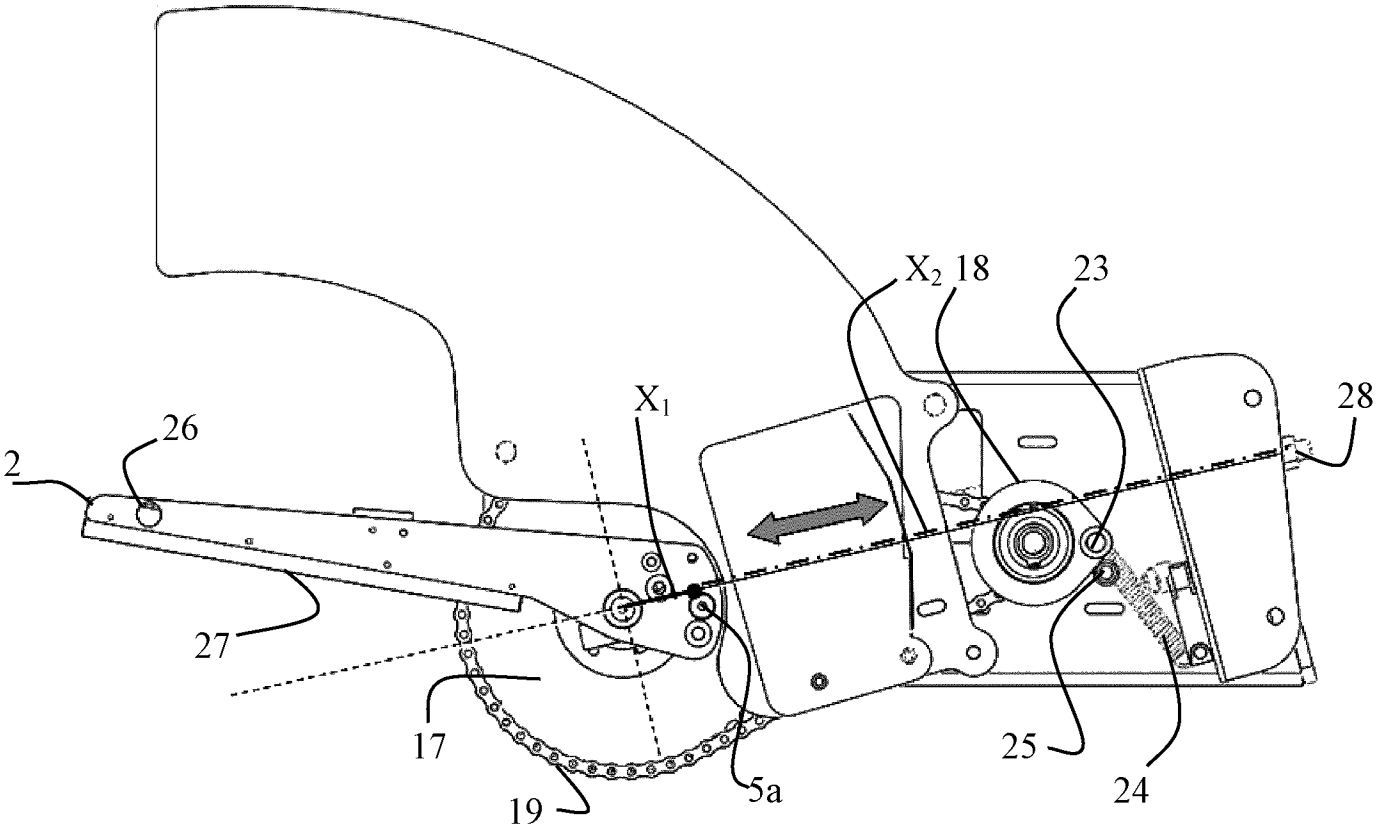
FIGS. 8 to 13 show kinematics of the device according to the invention in a top view, with the longitudinal axes X1 and X2 of the connecting rod 4 and the draw-spring 6 being shown.

A rest position of the device 1 is defined, wherein the X3 axis and the X1 axis of the connecting rod 4 are superimposed. The X1 axis is a continuation of the X2 axis, with the connecting rod 4 being aligned with the draw-spring 6. This position is shown in FIGS. 2 and 8. In this position, the arm 2 is distant from the upper body 8 of the device 1 and is not pointing at said body 8. This position is called the "rest position", i.e. offset by a 180° rotation of the arm 2 with respect to the "zero point" position.

Figure 11:
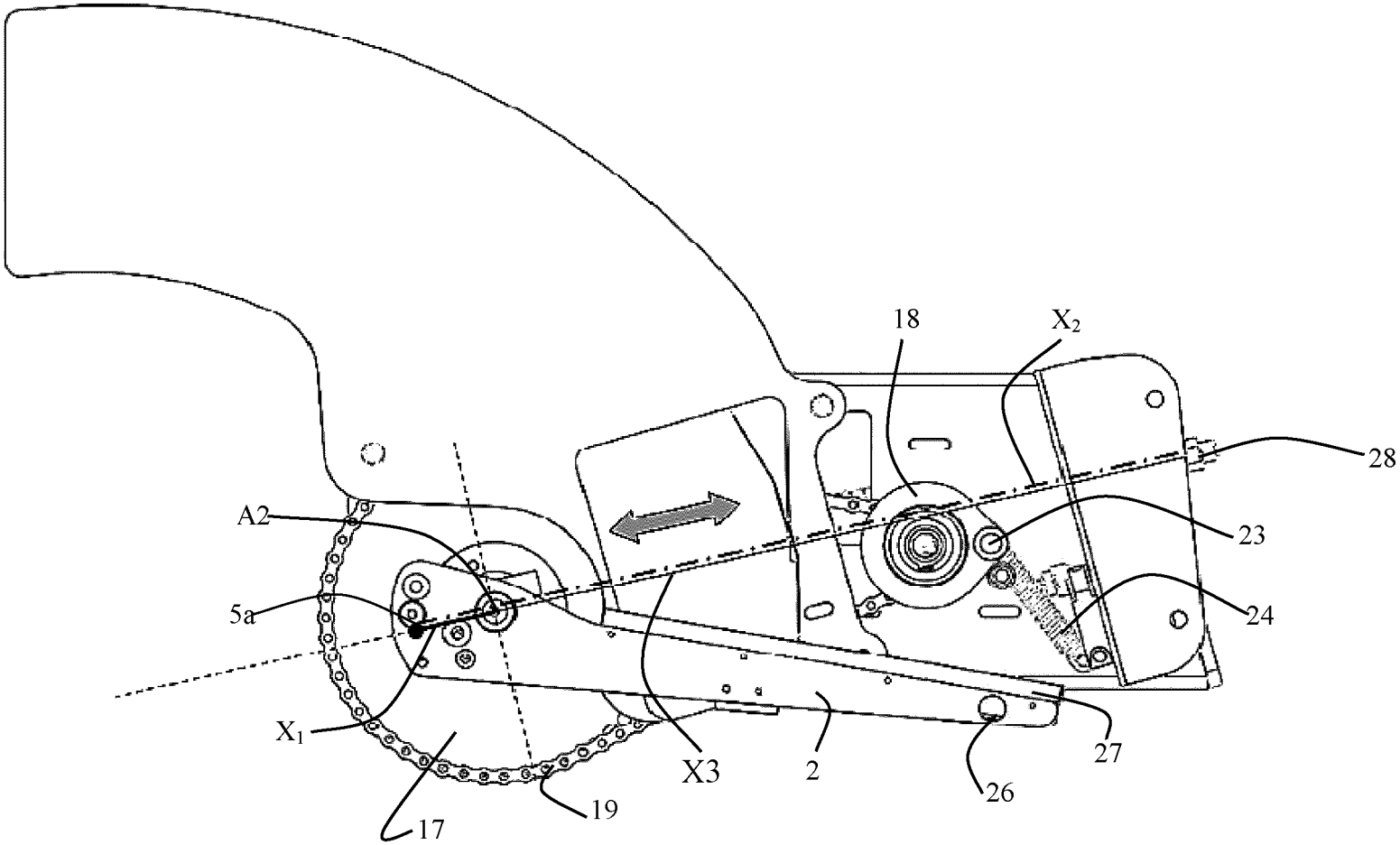

Similarly, a so-called "zero point" position of the device 1 illustrated in FIG. 11 is defined, wherein the X3 axis and the X1 axis of the connecting rod 4 are in line with each other, the X1 axis is superimposed on the X2 axis, with the connecting rod 4 being located above the draw-spring 6. No torque is exerted on the arm 2 because of the alignment of forces and their going through the axis of rotation of the arm; the position is balanced. This "zero point" position corresponds to the end of cocking position, for which the draw-spring 6 is liable to relax and the device 1 to throw a target. This position, illustrated in FIG. 11 is located, while referring to the left-hand direction, just before the position shown in FIGS. 4 and 12.

Figure 4:
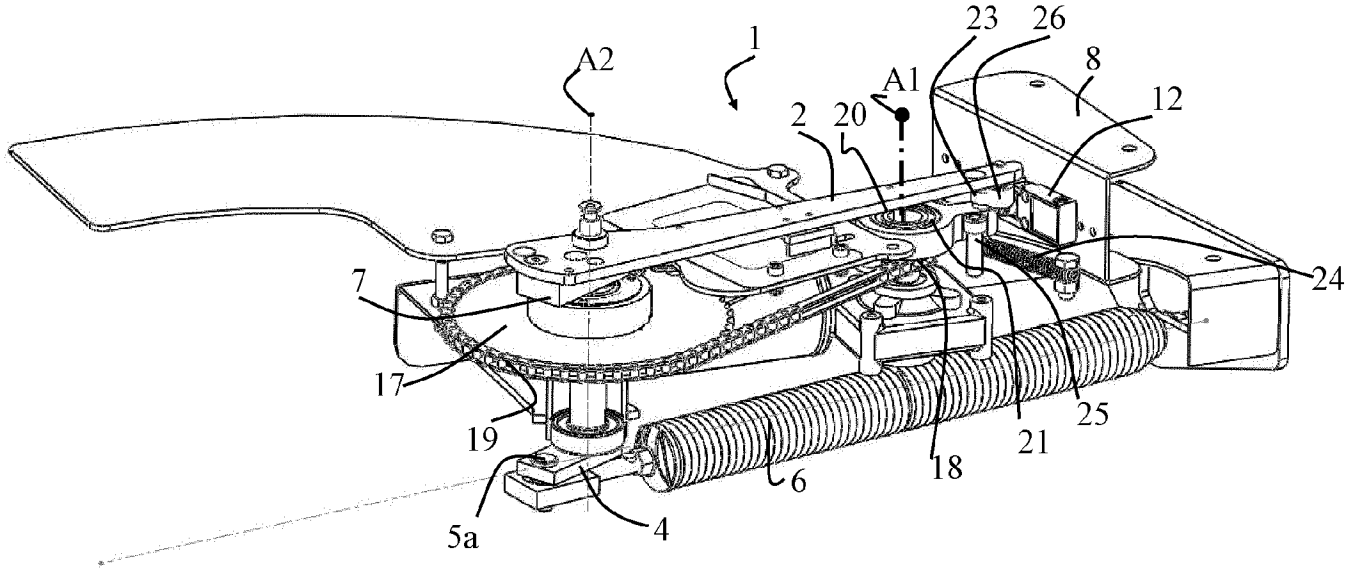
Figure 12:
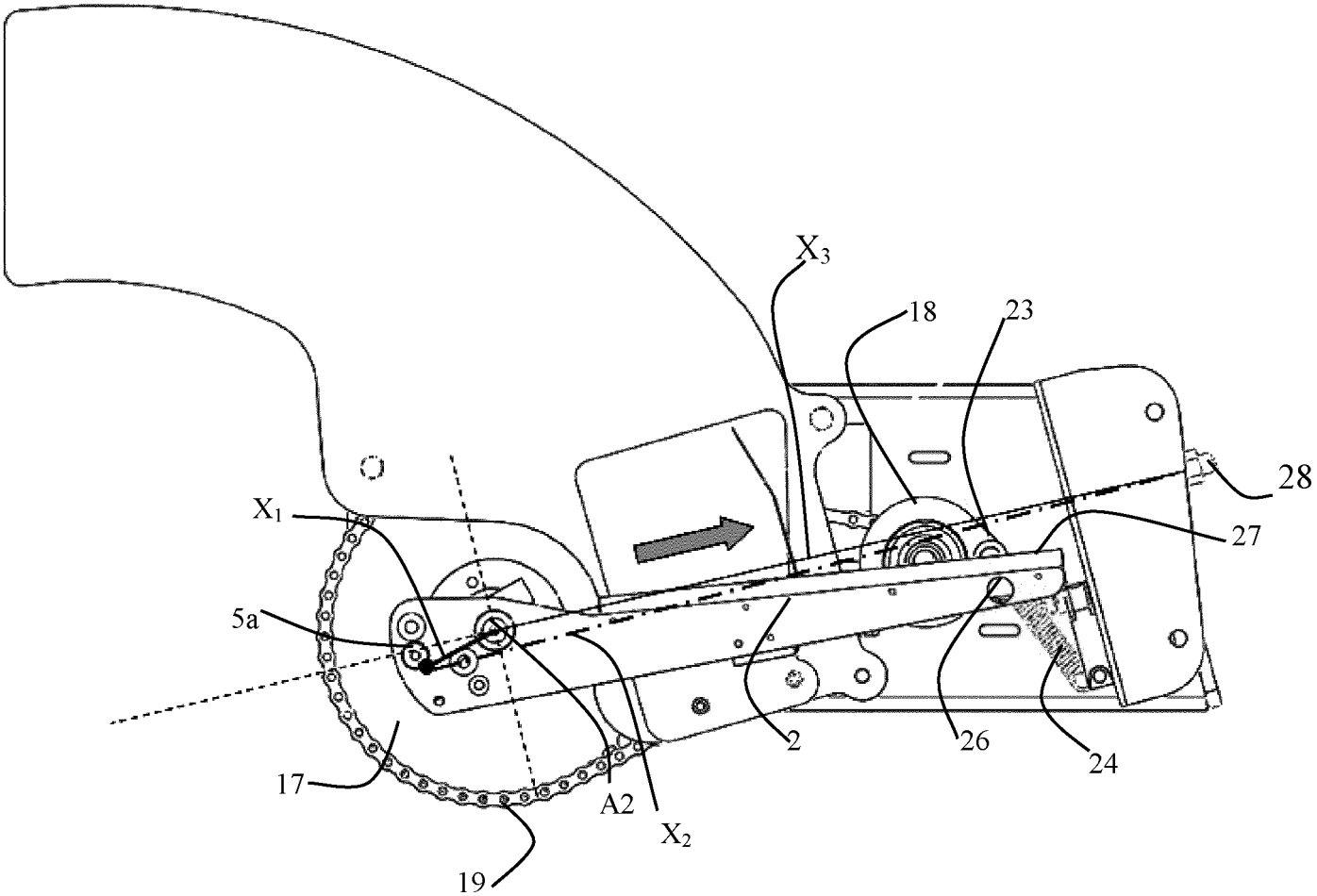

In FIGS. 4 and 12, the position of the arm 2 is slightly beyond the "zero point". This position is called the throwing position. The throwing position is preferably located in an angular sector of 5 to 10° beyond the zero point in the direction of rotation of the arm.

Figure 3:
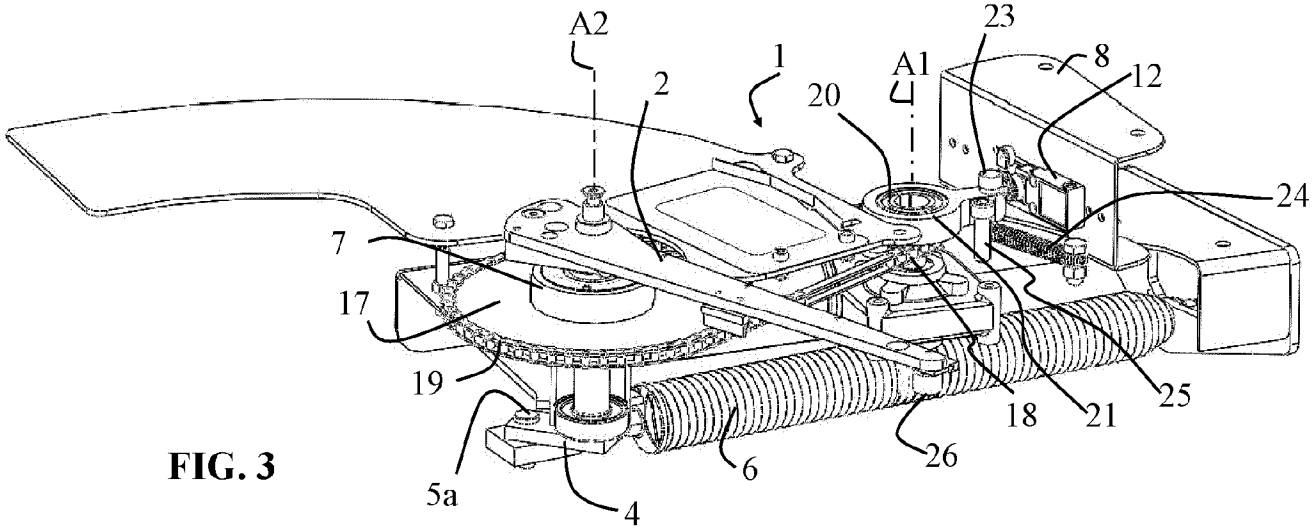
Figure 9:
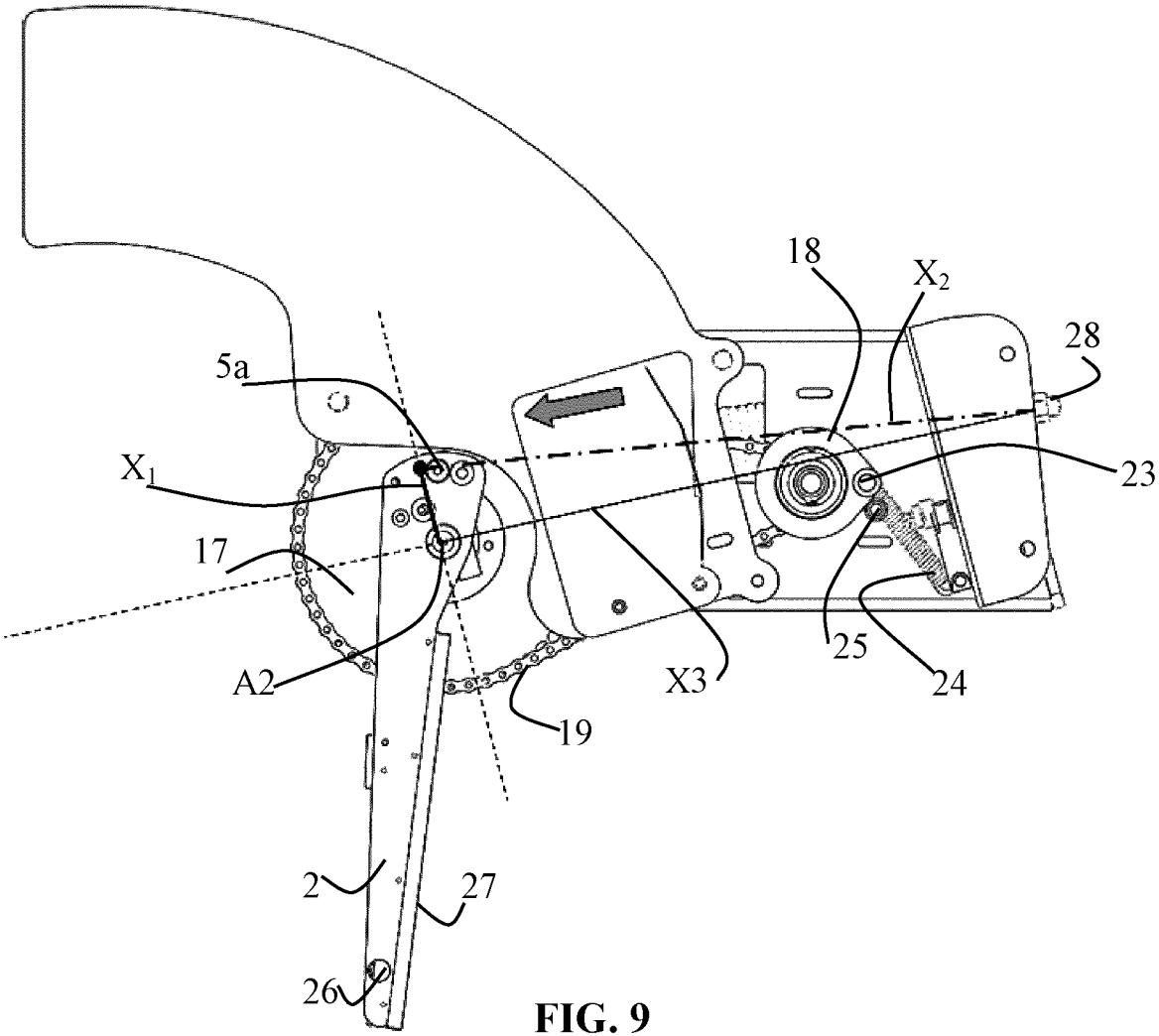
Figure 10:
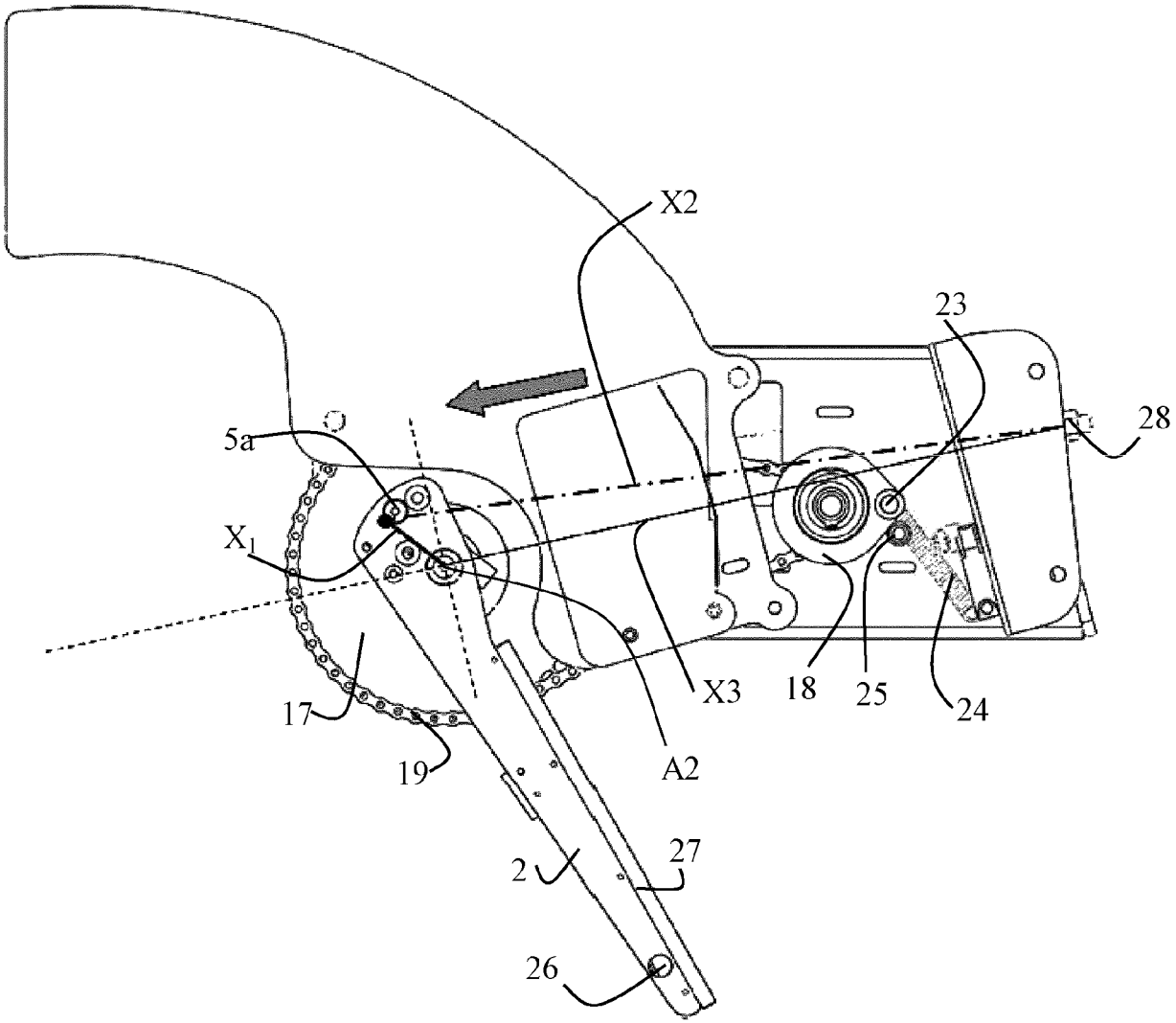

In the method according to the invention, the step of cocking the arm 2 of the device 1 may start from an initial position shown in FIGS. 3 and 9. During the previous rotation of the arm 2 for a throw, the inertia of the arm 2 made it go beyond the rest position shown in FIGS. 2 and 8 to complete its rotation to the position shown in FIGS. 3 and 9, i.e. approximately at 270° relative to the "zero point". The arm 2 is held in this start position that shortens the step of cocking relative to a step of cocking starting from the rest position. This shortening results from the action of the free wheel 7 associated with the shaft of rotation 3 of the arm 2 and positioned above the pinion 17, which keeps the arm 2 in this position before the step of cocking.

During the step of cocking, the arms 2 rotates, as it is driven by the geared motor 9 up to the "zero point", counter-clockwise. A device having an arm rotating in the other direction may also be designed. The geared motor 9 drives the pinion 17 of the shaft 3 of rotation of the arm 2 via the drive pinion 18 and causes the shaft 3 to rotate while the draw-spring 6, illustrating the throwing means of the device 1, tightens.

At the "zero point", the connecting rod 4 is still opposed to the retraction of the draw-spring 6 but ceases to be, beyond the "zero point" in the throwing position. This is shown in FIGS. 4 and 12. The draw-spring 6 could then return to its start position by instantly returning to its non stretched position and thereby cause an accelerated rotation of the arm 2 for throwing the target. This is then prevented, according to the present invention, by means for locking the throwing means in abutment, using the draw-spring 6, while keeping these in tension.

According to one possibility of the present invention, the throwing method provides a shut-down of the geared motor 9 beyond the "zero point". The shut-down of the geared motor 9 may be enabled by the contactor 12 carried by the upper body 8 of the device 1, with such contactor 12 being able to cut the power supply to the geared motor 9 when contacted by the end of the arm 2. The contactor 12 is positioned substantially in contact with the arm 2 "at the zero point". The inertia of the arm 2 drives it to the throwing point, beyond the "zero point", alternately the contactor 12 may postpone stopping the geared motor 9 to bring the arm 2 in the throwing position. The cut may occur before or simultaneously with the locking of the throwing means in tension. In this configuration, the device 1 is waiting for an order to throw a target.

Further to an order to throw a target, for example given by the shooter, the geared motor 9 is started again and the method according to the invention comprises a step of driving the device 1 by the geared motor 9, with such step ending with the unlocking of the throwing means in tension.

Advantageously, the means for locking the throwing means in the form of the draw-spring 6 are means acting on the arm 2 and having the following characteristics while referring to FIGS. 2 to 7.

A crank pin 21, having a free wheel 20 inside is provided on the output pin of the geared motor 9 rotating about the A1 axis, above the drive pinion 18. The free wheel 20 allows the rotation of the crank pin 21 clockwise or, if the latter is locked, the rotation of the geared motor 9 counter-clockwise. The crank pin 21 carries a pin 22, at its periphery, with the pin 22 being eccentric relative to the A1 axis of the geared motor 9. A roller 23, free to rotate, is mounted on the pin 22 thus turning about a substantially vertical axis.

A resilient means, in the form of a spring 24, having one end connected to the upper body 8 of the device 1 and the other end connected to the lower part of the pin 22 holds the lower portion of the pin 22 against a stop 25. In another embodiment, the spring 24 can press the edge of the crank pin 21 against the stop 25.

A lug 26 is fixed to the free end of the throwing arm 2 and on the underside thereof. The roller 23 is located on the trajectory of the lug 26 upon rotation of the arm 2 about the A2 axis. The A2 axis of the pinion 17 and of rotation of the arm 2, the A1 axis of the drive pinion 18 and of the geared motor 9 and the pin 22 are arranged in this order. The contactor 12 is located on the trajectory of the arm 2.

As mentioned above, in the throwing method according to the present invention, the arm 2 reaches the "zero point" position and goes beyond upon completion of the arm 2 cocking phase. The free end of the arm 2 switches the contactor 12 which cuts the power supply to the geared motor 9. Beyond the "zero point" the traction exerted by the draw-spring 6 brings the lug 26 of the arm 2 with the roller 23 into contact. When the geared motor 9 is stationary, the free wheel 20 opposes the movement of the crank pin 21. This is shown in FIGS. 4 and 12.

Figure 5:
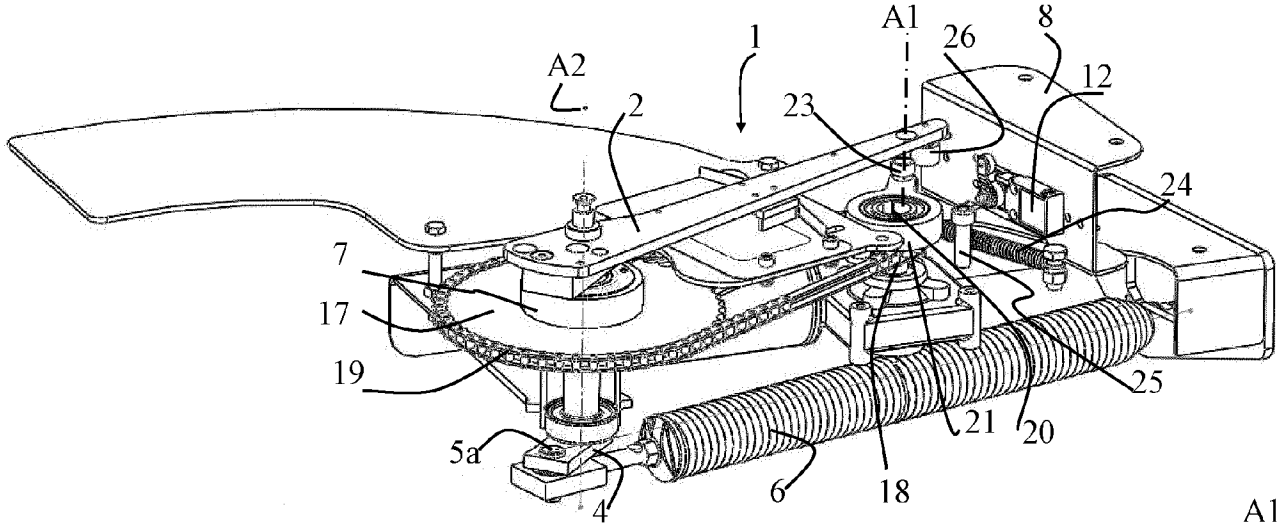
Figure 13:
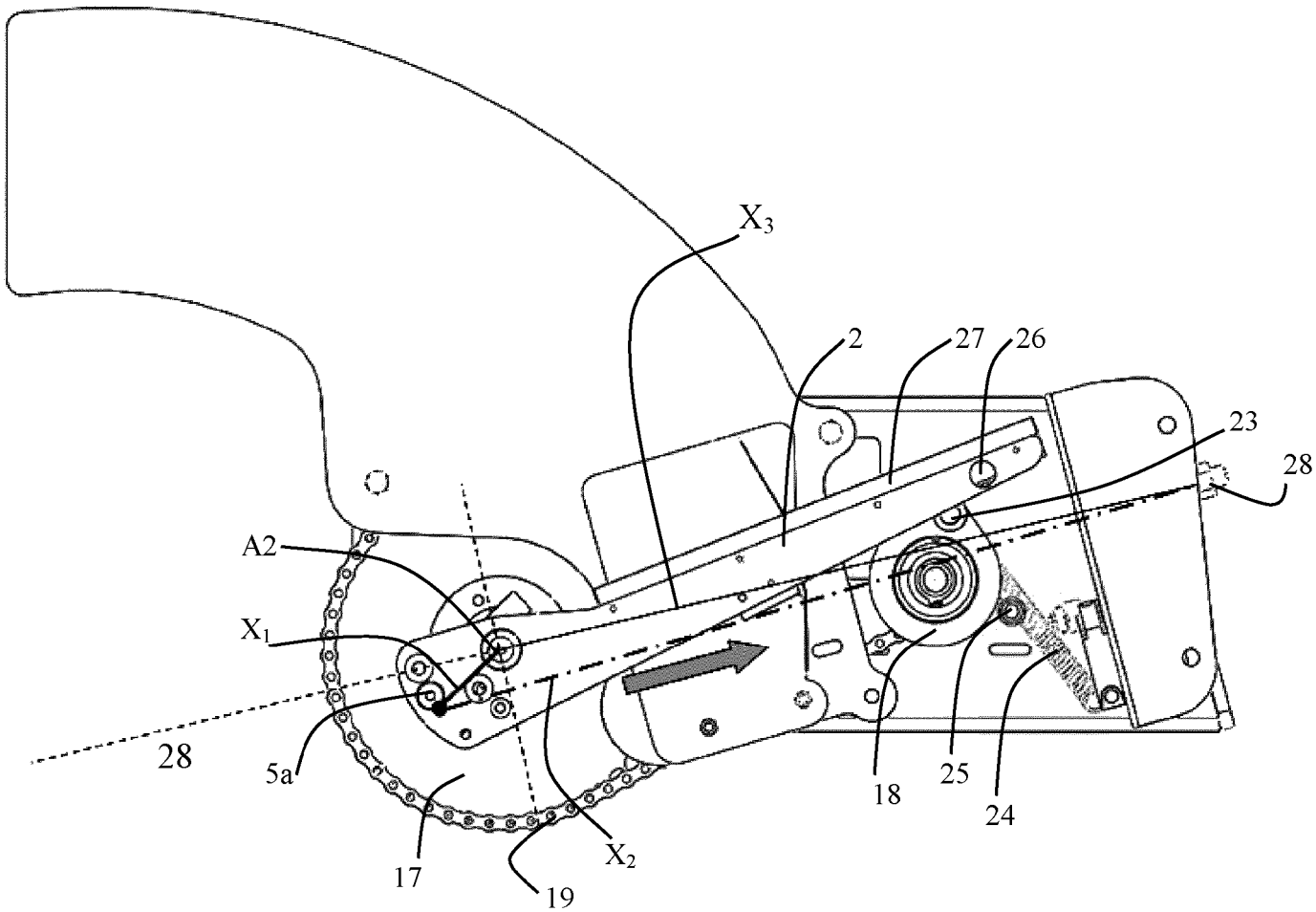

When the geared motor 9 is supplied again, for example after an order to throw, it rotates the free wheel 20 and therefore the roller 23, thereby releasing the arm 2. This is shown in FIGS. 5 and 13. The lug 26 of the arm 2 rotates about the roller 23 and the roller 23 is no longer an obstacle to the progress of the arm 2. The return to the non stretched position of the draw-spring 6 follows, which causes the throwing of the target which is then positioned against the fixture 27 of the arm 2, which was particularly visible in FIGS. 2 and 7.

Advantageously, the dimensions of the pinions 17 and 18 make it possible to create a reduction which limits the pressure of the lug 26 on the roller 23.

The throwing method according to the invention thus comprises a step of throwing by ejection of the target by the arm 2, upon the automatic release of the throwing means formed by the draw-spring 6, with no locking means holding these any longer while in a stretched position.

Figure 6:
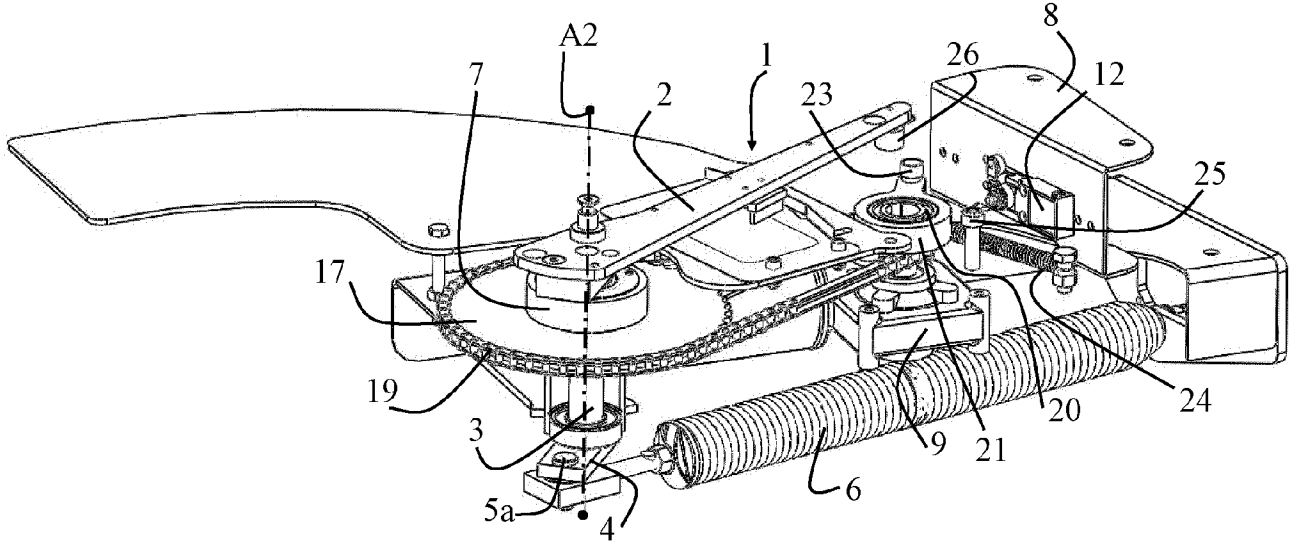
Figure 7:
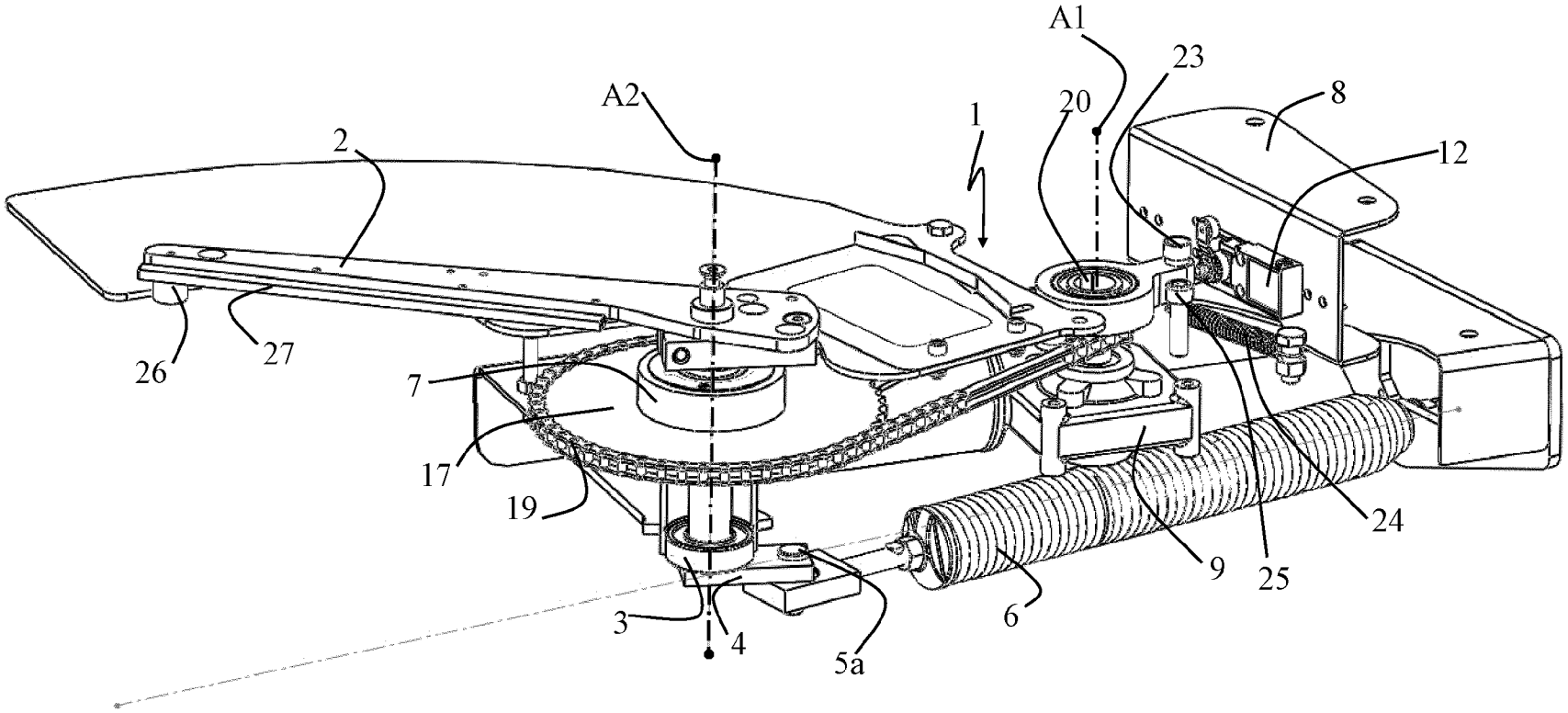

This step of throwing the target by ejection goes on sequentially with the positions shown in FIGS. 6 and 7 and 13, as well as with the rest position shown in FIGS. 2 and 8. Such rest position shown in FIGS. 2 and 8 is gone beyond, with the arm 2 reaching, because of its inertia, the position shown in FIGS. 3 and 9. This position is kept as the starting position for a new target throwing by the throwing arm 2 rotating counter-clockwise.

According to the invention, there is no timing problem since the geared motor 9 only is acted upon, with the release system being mechanically bound thereto. The pressure of the arm 2 on the roller 23 is thus completely controlled and unchanging. The electrical control is thus simplified and risks of malfunction are reduced. Only a defective draw-spring 6 could lead to a burst start of the arm 2. The safety of persons near the device 1 is thereby significantly improved as compared to the embodiments of the prior art shown in FIG. 1.

REFERENCES

1. Device
1a, 1b. Device
2. Arm
3. Shaft

-continued

| REFERENCES | |
|---|---|
| 4. | Connecting rod |
| 5. | Nipple |
| 5a. | Pivot |
| 6. | Spring |
| 7. | Free wheel |
| 8. | Upperbody |
| 8a. | Cross-piece |
| 8b. | Lower body |
| 9. | Geared motor |
| 10. | Crank pin |
| 11. | Nipple |
| 12. | Stop |
| 13. | Trigger |
| 14. | Axis |
| 15. | Electromagnet |
| 16. | Spring |
| 17. | Pinion |
| 18. | Drive pinion |
| 19. | Chain |
| 20. | Free wheel |
| 21. | Crank pin |
| 22. | Axis |
| 23. | Roller |
| 24. | Spring |
| 25. | Stop |
| 26. | Lug |
| 27. | Fixture |
| 28. | Junction between the spring and the body |
| A1. | Axis |
| A2. | Axis |
| X1. | Longitudinal axis of the connecting rod 4 |
| X2. | Longitudinal axis of the spring 6 |
| X3. | Line going through the point 28 and the centre of the connecting rod 4 |

The invention claimed is:

1. A device for throwing targets comprising a rotationally movable throwing arm, draw-spring and geared motor powered by a power supply and comprising an output shaft comprising a first axis of rotation for cocking the arm by rotation of said arm up to a so-called "zero point" position where the draw-spring is in tension without exerting a torque on the arm, wherein it comprises a stop carried by the geared motor and a complementary stop carried by the arm, with the stop and the complementary stop being so configured as to be in abutment in a throwing position what is beyond the "zero point" so as to lock the arm in said position on a predetermined angular sector in a direction of rotation of the arm wherein the draw-spring is in tension and exerts a torque on the arm and as to release the arm beyond the throwing position wherein the draw-spring relaxes to rotate the arm for throwing the target and wherein the arm comprises a rotating shaft, with said shaft carrying a pinion comprising a second axis of rotation driven by a second drive pinion comprising a third axis of rotation connected to the output shaft, with the stop being carried on the periphery of a crank pin comprising a fourth axis of rotation rotating about the output shaft of the geared motor wherein the crank pin is engaged with the output shaft, the first axis of rotation of the output shaft, and the device comprising a contactor which is configured to cut the power supply when contacted by an end of the arm thereby stopping the geared motor, the contactor being positioned substantially in contact with the end of the arm at the "zero point" position, and wherein the first, second, third, and fourth axes of rotation are coaxial.

2. The device according to claim 1, wherein the crank pin is mounted on a free wheel, with said free wheel enabling the pin to rotate in the direction opposite the direction of rotation of the geared motor.

3. The device according to claim 1, wherein the stop of the crank pin is carried by a pin eccentric relative to the output shaft of the geared motor, with said stop being in the form of a roller rotating at the upper end of the eccentric pin.

4. The device according to claim 1, wherein the complementary stops carried by the arm are in the form of a lug contacting the stop upon rotation of the arm beyond the "zero point".

5. The device according to claim 1, wherein two pinions are driven by a chain or a belt running around said pinions.

6. The device according to claim 1, wherein a free wheel is inserted into the pinion carried by the rotating shaft, with the outer cage of the free wheel rotating in the direction of rotation of the arm.

7. The device according to claim 1, comprising a stationary body, with a stop made integral with said body bearing against the edge of the crank pin.

8. The device according to claim 7, wherein the stop is pressed by the action of a spring against the edge of the crank pin.

9. The device according to claim 1, wherein the draw-spring is adapted to be tensioned upon rotation of the arm, with the return of the spring to a relaxed position causing the rotation of the arm for enabling the throwing of the target by the arm.

10. The device according to claim 9, wherein the draw-spring is fixed to one of its ends to a body of the device, with its other end being articulated to one end of a connecting rod another end of which is connected to the rotating shaft.

* * * * *